US012285664B2

(12) United States Patent
Searle et al.

(10) Patent No.: US 12,285,664 B2
(45) Date of Patent: Apr. 29, 2025

(54) GOLF BAG COVER WITH AIR-RELEASE CLUB RETENTION SYSTEM

(71) Applicant: GSTC LLC, Scottsdale, AZ (US)

(72) Inventors: Gideon P. Searle, Scottsdale, AZ (US); Theodore Bobrick Root, Jr., Charlotte, NC (US)

(73) Assignee: GSTC LLC, Scottsdale, AZ (US)

( * ) Notice: Subject to any disclaimer, the term of this patent is extended or adjusted under 35 U.S.C. 154(b) by 146 days.

(21) Appl. No.: 18/240,757

(22) Filed: Aug. 31, 2023

(65) Prior Publication Data

US 2024/0075360 A1 Mar. 7, 2024

Related U.S. Application Data

(60) Provisional application No. 63/403,155, filed on Sep. 1, 2022.

(51) Int. Cl.
*A63B 55/00* (2015.01)
*A63B 55/40* (2015.01)

(52) U.S. Cl.
CPC ..... *A63B 55/406* (2015.10); *A63B 55/40* (2015.10)

(58) Field of Classification Search
CPC ... A63B 55/406; A63B 55/40; A63B 2209/08; A63B 2209/00; A63B 2209/10
USPC ..... 206/315.4
See application file for complete search history.

(56) References Cited

U.S. PATENT DOCUMENTS

| | | | | |
|---|---|---|---|---|
| 5,704,475 | A | 1/1998 | Jack | |
| 5,921,387 | A | 7/1999 | Arzoomanian et al. | |
| 5,967,324 | A * | 10/1999 | Izzo | A63B 60/62 150/159 |
| 6,381,998 | B1 * | 5/2002 | Good | A63B 55/40 70/64 |
| 7,281,398 | B1 * | 10/2007 | Sims | A63B 55/40 70/64 |
| 2006/0138161 | A1 * | 6/2006 | Wempe | G07F 11/20 206/315.6 |
| 2009/0255841 | A1 | 10/2009 | Sanches et al. | |
| 2020/0191522 | A1 * | 6/2020 | Searle | F41C 33/06 |

FOREIGN PATENT DOCUMENTS

| | | | | |
|---|---|---|---|---|
| DE | 20111200 U1 * | 10/2001 | ..... | A63B 55/00 |

* cited by examiner

*Primary Examiner* — Nathan J Jenness
*Assistant Examiner* — Justin Caudill
(74) *Attorney, Agent, or Firm* — NEO IP

(57) ABSTRACT

The present invention includes a golf bag cover with interior surfaces lined with a flexible container filled with air and microbeads. The flexible container includes a plurality of openings each configured to receive a golf club. The flexible container includes at least one valve to evacuate air from within the flexible container to compactify the microbeads around the golf clubs, thereby securing them. In one embodiment, a snake-like retainer is threaded between golf clubs within the golf bag cover and air is evacuated from the snake-like retainer so as to compactify microbeads within the snake-like retainer around the golf clubs in order to secure them.

20 Claims, 6 Drawing Sheets

GOLF BAG COVER WITH AIR-RELEASE CLUB RETENTION SYSTEM

CROSS REFERENCES TO RELATED APPLICATIONS

This application is related to and claims priority from the following US patent applications. This application claims priority to and the benefit of U.S. Provisional Patent Application No. 63/403,155 filed Sep. 1, 2022, which is incorporated herein by reference in its entirety.

BACKGROUND OF THE INVENTION

1. Field of the Invention

The present invention relates to golf bag covers, and more specifically to golf bag covers including air-release club retention systems.

2. Description of the Prior Art

It is generally known in the prior art to provide golf bag covers.

Prior art patent documents include the following:

U.S. Pat. No. 5,921,387 for Protective cover for a golf bag by inventors Arzoomanian et al., filed Apr. 14, 1997 and issued Jul. 13, 1999, discloses a removable protective cover used in combination with a golf bag which includes a bladder for protecting the heads of golf clubs and other equipment carried in a golf bag. The cover is removably affixable to the golf bag and when disposed thusly, the bladder may be inflated to securingly envelop the golf club heads and provide a protective barrier against the club heads contacting each other and against club heads contacting some other hard surface, e.g. the ground, conveyor belt, etc. The golf bag includes a tray having a plurality of substantially downwardly extending tubes suitable for holding golf clubs. A recess is also provided in the tray for holding miscellaneous golf equipment such as, for example, balls, tees, etc. The tray also includes a cigar or cigarette holder and a utility outlet for connection to a computer or cellular phone. The cover includes an inclined top surface, while the bottom surface of the golf bag is substantially horizontal. The golf bag and cover preferably include hard external shells and are hexagonal in cross-section.

US Patent Publication No. 2009/0255841 for Inflatable shipping device and method of forming and using same by inventors Sanches et al., filed Jun. 23, 2009 and issued Jun. 15, 2010, discloses a lightweight assembly exhibiting a durable and puncture resistant outer material. An inflatable bladder is sandwiched between the outer material and an inner closable liner. One or more elongated articles, such a golf bag with clubs, is placed within an open interior bounded by the inner liner and, upon employing a built-in pump assembly incorporated into an attached skid plate, communicates through an inlet line to inflate the bladder in a substantially inward fashion to bias and cushion about the bag and clubs. A release valve formed at a top location of the bladder is revealed by a zippered portion in the bag, and to deflate the bladder.

U.S. Pat. No. 5,704,475 for Inflatable golf club protector by inventor Jack, filed Apr. 23, 1996 and issued Jan. 6, 1998, discloses a protective device for covering and protecting golf clubs in a golf bag comprising an inflatable body portion, the body portion comprising a tubular sleeve having a closed end and an open end for slipping over the golf clubs, and a valve for inflating the body portion wherein the inner body portion is shaped to the contour of the clubs for enveloping and resiliently securing the head and upper shaft portions of the golf clubs against movement. The inner and outer walls of the body portion are sealed together at their peripheral edges, and at a plurality of points over their respective areas forming a plurality of fluid chambers, preferably in fluid communication with each other, for conforming to the clubs. The golf club protective device may also be secured to the inside of a conventional golf bag cover, whether the cover is of the travel bag type fully enclosing the golf bag, or a hood enclosing only the club heads and the upper end of the golf bag.

SUMMARY OF THE INVENTION

The present invention relates to golf bag covers, and more specifically to golf bag covers including air-release club retention systems.

It is an object of this invention to provide a golf bag cover capable of safely retaining golf clubs while not exerting high stress on the stem-head interface of each club.

In one embodiment, the present invention is a golf bag cover including a flexible container lining; a plurality of members extending from an interior top surface of the golf bag cover to a bottom of the golf bag cover; wherein the plurality of extending members define at least one opening between the plurality of extending members; wherein the at least one opening is configured to receive at least one golf club; a plurality of microbeads contained within at least one layer of the flexible container lining; at least one valve connected to the flexible container lining; and wherein the flexible container lining and the plurality of microbeads are configured to conform to the at least one golf club upon evacuation of air from the flexible container lining.

In another embodiment, the present invention is a system for housing golf clubs including a golf bag cover; a flexible container lining; a plurality of members extending from an interior top surface of the golf bag cover to a bottom of the golf bag cover; wherein the plurality of extending members define at least one opening between the plurality of extending members; wherein the at least one opening is operable to receive at least one golf club; a plurality of microbeads contained within at least one layer of the flexible container lining; at least one valve connected to the flexible container lining; and wherein the flexible container lining and the plurality of microbeads are operable to conform to the at least one golf club upon evacuation of air from the flexible container lining.

In yet another embodiment, the present invention is a golf bag cover including a flexible container lining; a plurality of members extending from an interior top surface of the golf bag cover to a bottom of the golf bag cover; wherein the plurality of extending members define at least one opening between the plurality of extending members; wherein the at least one opening is configured to receive at least one golf club; a plurality of microbeads contained within at least one layer of the flexible container lining; at least one valve connected to the flexible container lining; wherein the flexible container lining and the plurality of microbeads are configured to conform to the at least one golf club upon evacuation of air from the flexible container lining; wherein the flexible container lining and the at least one valve are configured to connect to at least one vacuum pump operable to evacuate air from the flexible container lining; and wherein the at least one opening is smaller than a club head of the at least one golf club and is configured to deform to enable the club head to enter the golf bag cover.

These and other aspects of the present invention will become apparent to those skilled in the art after a reading of the following description of the preferred embodiment when considered with the drawings, as they support the claimed invention.

DETAILED DESCRIPTION

Figure 1:
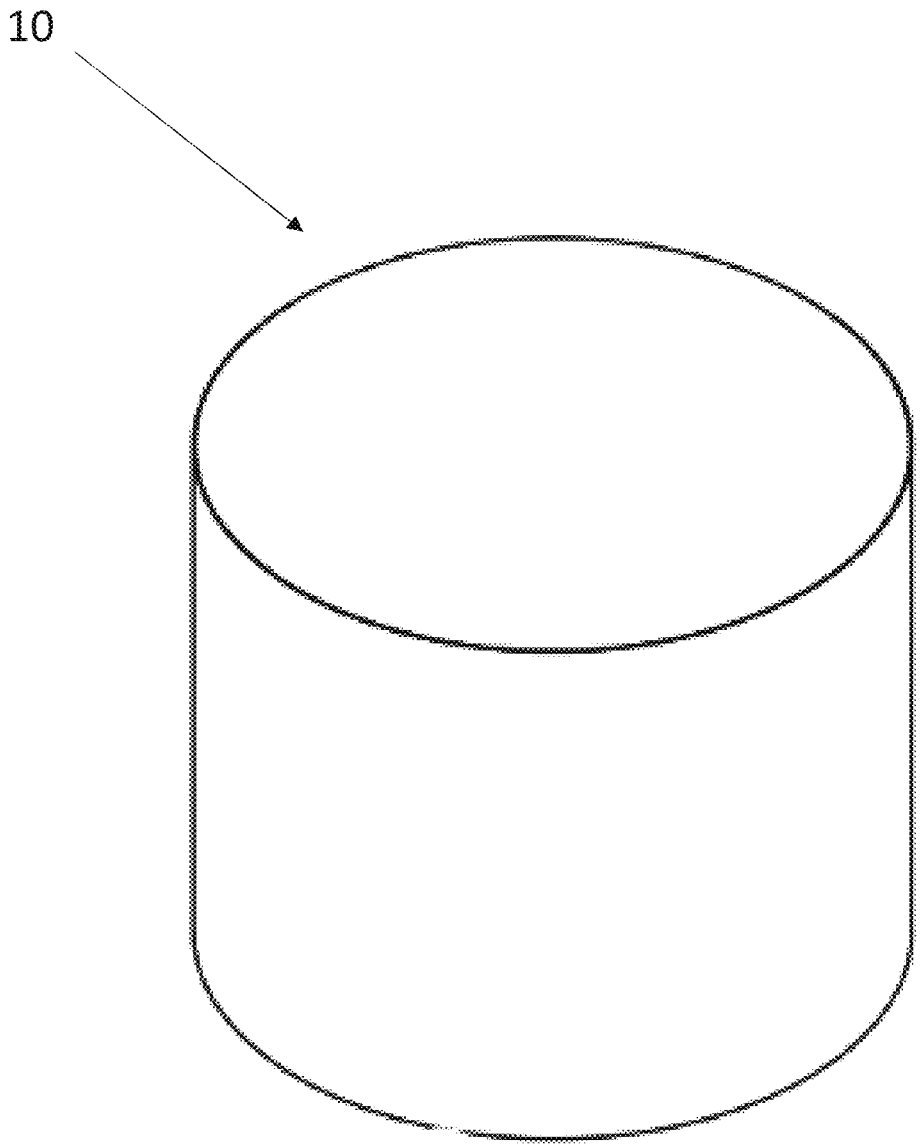
FIG. 1 illustrates a perspective view of a golf bag cover according to one embodiment of the present invention.

The present invention is generally directed to golf bag covers, and more specifically to golf bag covers including air-release club retention systems.

In one embodiment, the present invention is a golf bag cover including a flexible container lining; a plurality of members extending from an interior top surface of the golf bag cover to a bottom of the golf bag cover; wherein the plurality of extending members define at least one opening between the plurality of extending members; wherein the at least one opening is configured to receive at least one golf club; a plurality of microbeads contained within at least one layer of the flexible container lining; at least one valve connected to the flexible container lining; and wherein the flexible container lining and the plurality of microbeads are configured to conform to the at least one golf club upon evacuation of air from the flexible container lining.

In another embodiment, the present invention is a system for housing golf clubs including a golf bag cover; a flexible container lining; a plurality of members extending from an interior top surface of the golf bag cover to a bottom of the golf bag cover; wherein the plurality of extending members define at least one opening between the plurality of extending members; wherein the at least one opening is operable to receive at least one golf club; a plurality of microbeads contained within at least one layer of the flexible container lining; at least one valve connected to the flexible container lining; and wherein the flexible container lining and the plurality of microbeads are operable to conform to the at least one golf club upon evacuation of air from the flexible container lining.

In yet another embodiment, the present invention is a golf bag cover including a flexible container lining; a plurality of members extending from an interior top surface of the golf bag cover to a bottom of the golf bag cover; wherein the plurality of extending members define at least one opening between the plurality of extending members; wherein the at least one opening is configured to receive at least one golf club; a plurality of microbeads contained within at least one layer of the flexible container lining; at least one valve connected to the flexible container lining; wherein the flexible container lining and the plurality of microbeads are configured to conform to the at least one golf club upon evacuation of air from the flexible container lining; wherein the flexible container lining and the at least one valve are configured to connect to at least one vacuum pump operable to evacuate air from the flexible container lining; and wherein the at least one opening is smaller than a club head of the at least one golf club and is configured to deform to enable the club head to enter the golf bag cover.

Without using a cover, carrying golf clubs in transit risks one or more of the clubs falling out of the golf bag and potentially becoming lost. While golf bag covers currently exist, such covers do not include a reliable means to secure the golf clubs such that the clubs do not bump into each other, potentially damaging the clubs. This damage is especially risky at the relatively weak interface between the shaft of each club and the head of each club. Therefore, a golf bag cover is needed that more reliably secures golf clubs during transit.

Referring now to the drawings in general, the illustrations are for the purpose of describing one or more preferred embodiments of the invention and are not intended to limit the invention thereto.

FIG. 1 illustrates a perspective view of a golf bag cover according to one embodiment of the present invention. The golf bag cover 10 according to the present invention is configured to attach to and/or loosely sit atop a golf bag. In one embodiment, a bottom rim of the golf bag cover 10 includes a zipper mechanism configured to engage with a corresponding zipper mechanism on a top rim of a golf bag. In one embodiment, the golf bag cover 10 includes one or more straps, one or more magnetic attachment points, and/or any other attachment means for connecting to a golf bag. The golf bag cover 10 shown in FIG. 1 is substantially cylindrical in shape, but one of ordinary skill in the art will understand that a golf bag cover 10 according to the present invention is also able to have a non-circular cross section (e.g., rectangular, triangular, pentagonal, hexagonal, octagonal, etc.). The bottom of the golf bag cover 10 includes an opening configured to receive golf clubs.

The material of the golf bag cover 10 is not intended to be limiting according to the present invention. In one embodiment, the golf bag cover 10 is formed from a tough, rigid material, such as carbon fiber reinforced plastic, fiberglass, polyethylene (e.g., high-density polyethylene (HDPE), ultra-high molecular weight polyethylene (UHMWPE)), etc. In another embodiment, the golf bag cover 10 is formed from a flexible material, such as a fabric or a flexible polymer (e.g., ethylene vinyl acetate (EVA), polypropylene (PP), polyethylene (PE), etc.).

In one embodiment, the golf bag cover 10 is formed from a plurality of materials. For example, the golf bag cover 10 is formed from a first layer of a semi-rigid material, such as polyester or polyurethane. Rigid fiber-reinforced plastic plates (e.g., woven carbon fiber, unidirectional carbon fiber, fiberglass, etc.) are attached to one or more areas of the semi-rigid material first layer to provide additional toughness and stress resistance. Adding separate plates of fiber-reinforced plastic reduces the manufacturing difficulties that come with producing the entire cover out of, for example, carbon fiber.

Figure 2:
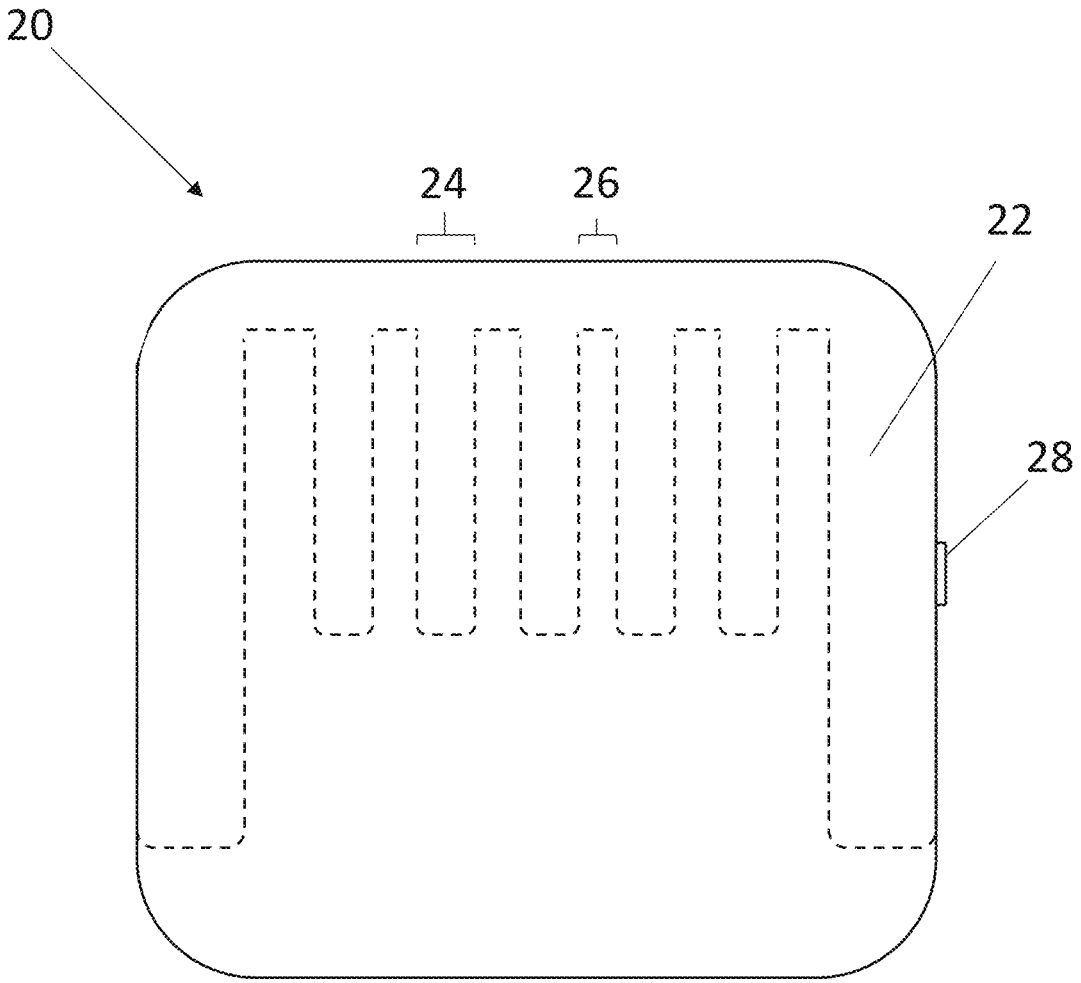
FIG. 2 illustrates a transparent side view of a golf bag cover according to one embodiment of the present invention.
Figure 3:
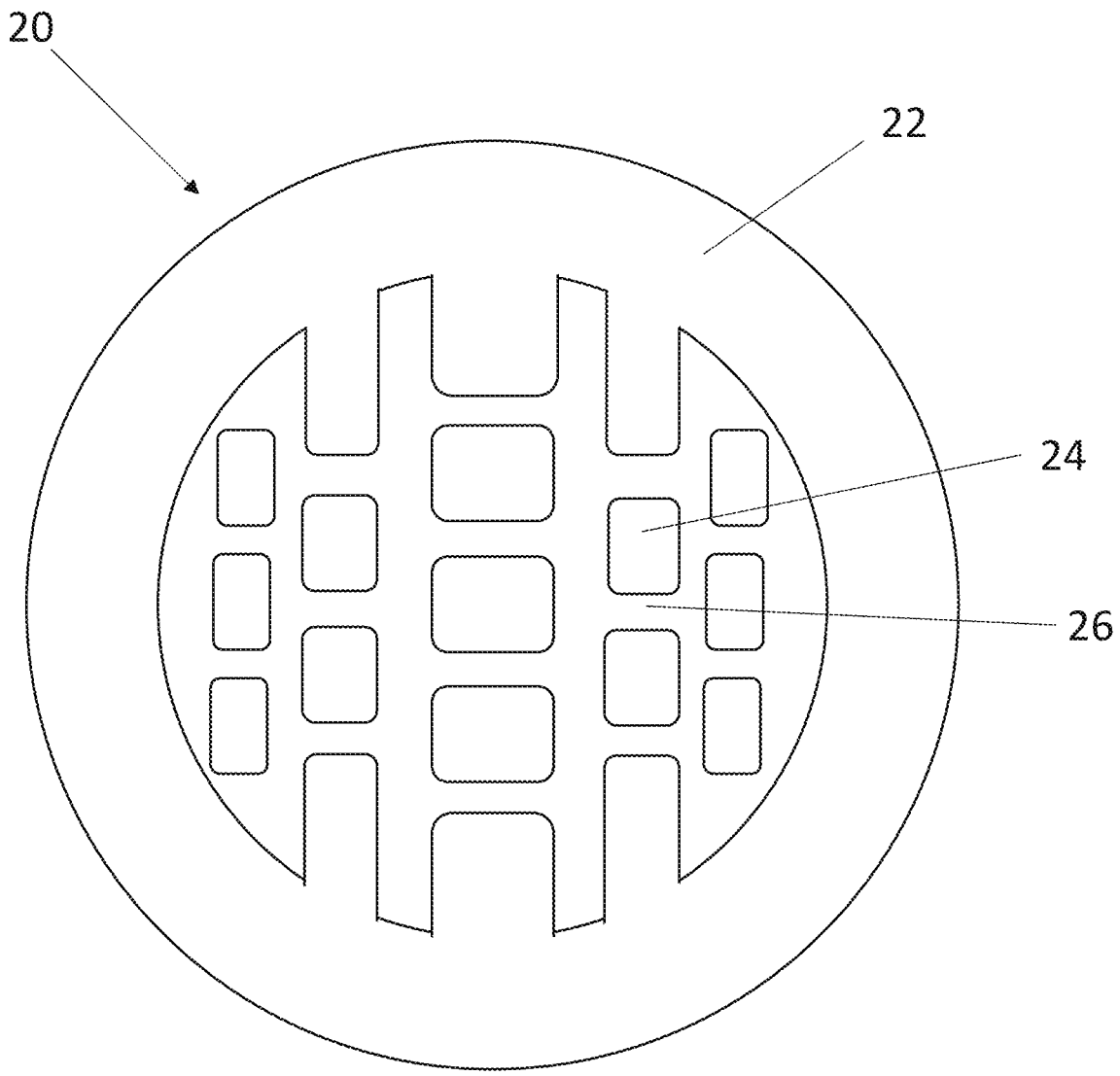
FIG. 3 illustrates a bottom view of the golf bag cover of FIG. 2.

FIGS. 2-3 illustrate a golf bag cover according to one embodiment of the present invention. In one embodiment, a golf bag cover 20 includes a flexible container 22 lining interior side walls and a top surface of the golf bag cover 20. In one embodiment, the flexible container 22 includes a plurality of members 24 extending from the interior top surface of the golf bag cover 20 toward the bottom of the golf bag cover 20. The plurality of members 24 define a plurality of openings 26 between the plurality of members 24. The plurality of openings 26 are each configured to receive a golf club.

In one embodiment, the flexible container 22 includes a plurality of microbeads and/or other retaining elements. The microbead filling is, in one embodiment, contained within at least one layer, wherein the at least one layer is constructed from any malleable natural or synthetic material, either woven or non-woven, such as cotton, polyester, polyurethane, cellophane, or any other material that is suitable for containing microbead filling. The flexible container 22 employs principles of "vacuum splints," "granular jamming," or similar negative pressure packaging mechanisms with granular particles. When in a normal pressure state, particles are loosely contained. The flexible container 22 includes at least one valve 28 for connecting to at least one vacuum pump. As air is evacuated from the retaining element, the containing layers and microbeads condense, resulting a in much firmer structure. Advantageously, the flexible container 22 allows for adjustability in an amount of air evacuated, such that resulting a strength of the flexible container 22 and pressure on an object (e.g., a golf club) matches the level of security desired.

When a golf club is inserted into one of the plurality of openings 26, the plurality of openings 26 are configured such that the head of the golf club is larger (or wider, or longer) than the corresponding opening 26. Because the head of the golf club is larger, the areas of the flexible container surrounding the opening 26 (e.g., adjacent members 24) deflect and deform to allow the golf club head to enter. When air is then evacuated from the flexible container 22 through the at least one valve 28, the shape of the flexible container 22 changes to conform to the one or more golf clubs inserted into the golf bag cover 20.

Figure 4:
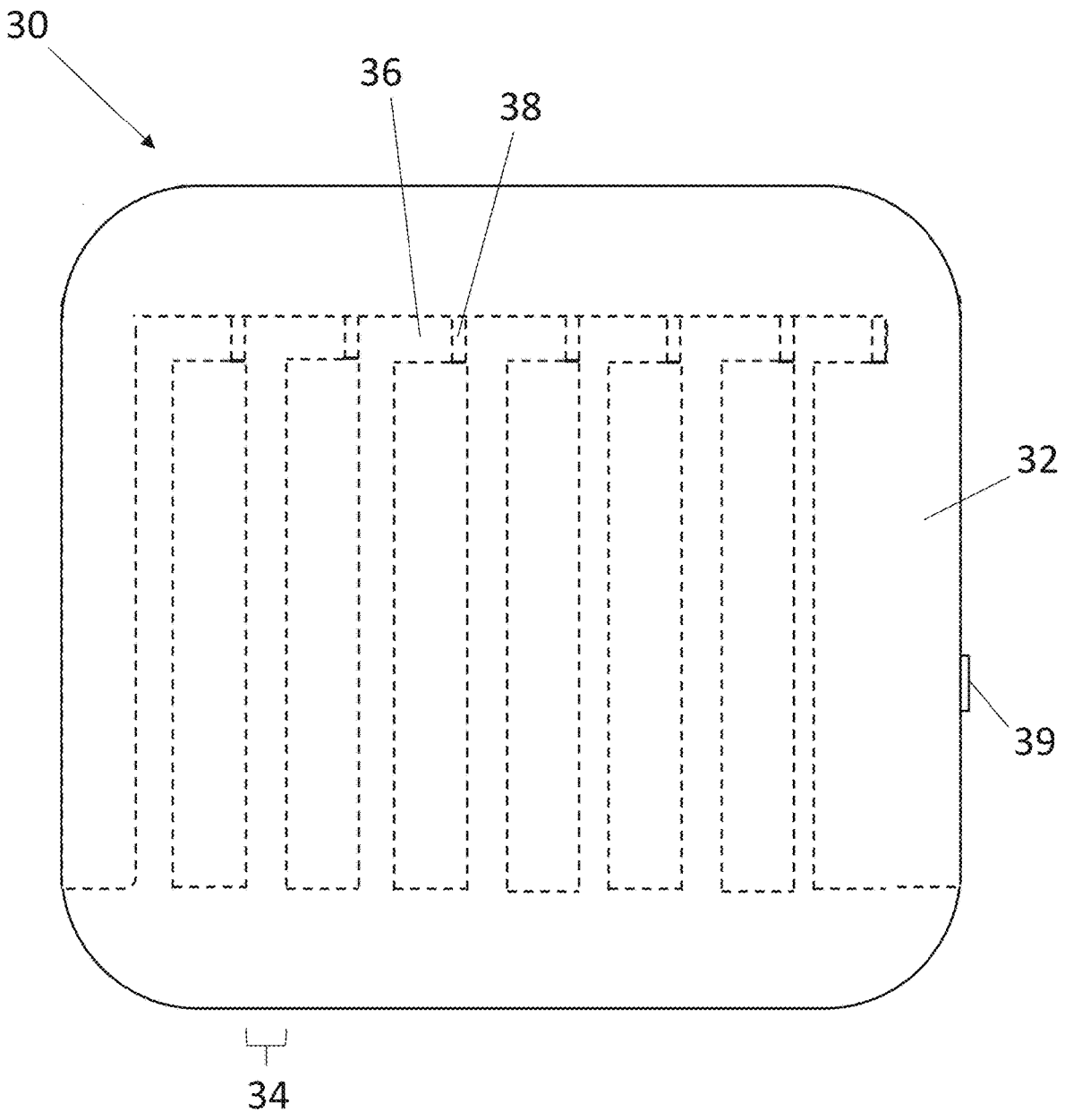
FIG. 4 illustrates a transparent side view of a golf bag cover according to one embodiment of the present invention.
Figure 5:
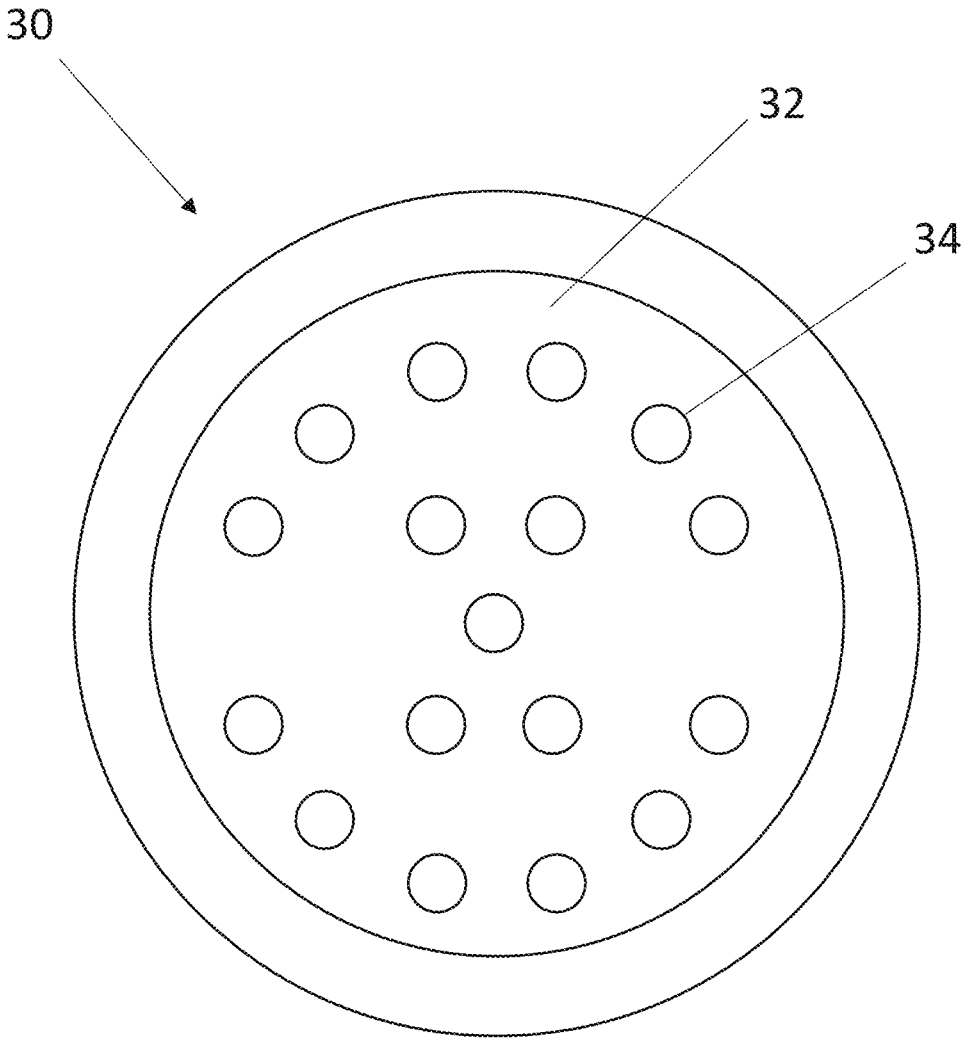
FIG. 5 illustrates a bottom view of the golf bag cover of FIG. 4.

FIGS. 4-5 illustrate a golf bag cover according to one embodiment of the present invention. In one embodiment, a golf bag cover 30 includes a flexible container 32 lining interior surfaces of the sides and top of the golf bag cover 30. The flexible container 32 includes a plurality of defined passages 34 configured to receive golf clubs. In one embodiment, the plurality of defined passages 34 include an elongated stalk region configured to hold a portion of the shaft of the golf club. At the end of the elongated stalk region nearest to the top of the golf bag cover 30, each of the plurality of defined passages 34 includes a head compartment 36 extending in a direction orthogonal to the elongated stalk region. The head compartment 36 is configured to hold the head of the golf club. In one embodiment, a section of the flexible container 32 closer to the top of the golf bag cover 30 than the head compartments 36 is attached to a section of the flexible container 32 further from the top of the golf bag cover 30 than the head compartments 36 by one or more connecting regions 38.

In one embodiment, the flexible container 32 includes a plurality of microbeads and/or other retaining elements. The microbead filling is, in one embodiment, contained within at least one layer, wherein the at least one layer is constructed from any malleable natural or synthetic material, either woven or non-woven, such as cotton, polyester, polyurethane, cellophane, or any other material that is suitable for containing microbead filling. The flexible container 32 employs principles of "vacuum splints," "granular jamming," or similar negative pressure packaging mechanisms with granular particles. When in a normal pressure state, particles are loosely contained. The flexible container 32 includes at least one valve 39 for connecting to at least one vacuum pump. As air is evacuated from the retaining element, the containing layers and microbeads condense, resulting a in much firmer structure. Advantageously, the flexible container 32 allows for adjustability in an amount of air evacuated, such that resulting a strength of the flexible container 32 and pressure on an object (e.g., a golf club) matches the level of security desired.

Figure 6:
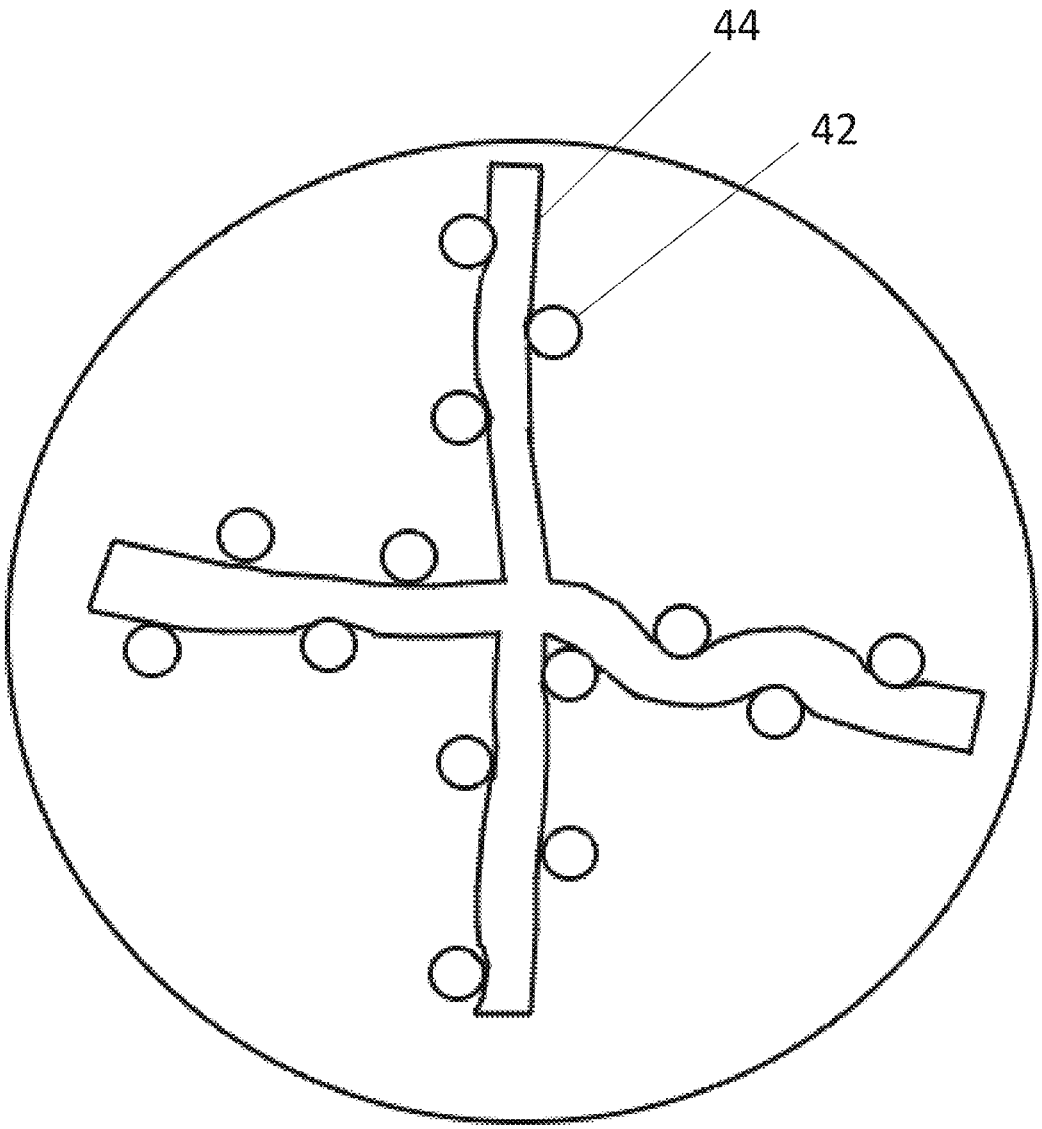
FIG. 6 illustrates a bottom view of a golf bag cover according to one embodiment of the present invention.

FIG. 6 illustrates a bottom view of a golf bag cover according to one embodiment of the present invention. In one embodiment, the golf bag cover does not include a flexible container lining the sides or top of the golf bag cover. Instead, in one embodiment, a plurality of golf clubs 42 are inserted into a bottom of the golf bag cover. A snake-like retainer 44 is threaded between each of the plurality of golf clubs 42 and is configured to contact a section of the shaft of each of the plurality of golf clubs 42. In one embodiment, the snake-like retainer 44 is filled with air and a plurality of microbeads. In one embodiment, the snake-like retainer 44 is a rectilinear extrusion including two or more linear extensions extending from a central point. By way of example and not limitation, the snake-like retainer 44 shown in FIG. 6 includes four linear extensions extending from a central point. In one embodiment, the ends of the two or more linear extensions are configured to be attached to interior surfaces of the sides and/or top of the golf bag cover so as to stabilize the snake-like retainer 44 within the golf bag cover. In one embodiment, the snake-like retainer 44 has a width of approximately one inch, a height of approximately 4.5 inches, and a length of approximately 4.5 feet. In one embodiment, the snake-like retainer 44 includes a valve configured to connect with a vacuum pump to evacuate air from the snake-like retainer 44 and compactify the beads in the snake-like retainer 44 around the plurality of golf clubs 42.

In one embodiment, the snake-like retainer 44 is manually threaded between each club, below the head of each club. Air within the snake-like retainer 44 is then released, compacting the beads within the snake-like retainer 44 and firmly coupling each club. Subsequently, a golf bar cover is placed over the club and the snake-like retainer 44. In one embodiment, the golf bar cover includes one or more retaining elements, such as a foam cushion lining the top and/or the side walls of the golf bar cover. In one embodiment, one or more internal surfaces of the golf bar cover is lined with hook and loop elements and an external surface of the snake-like retainer 44 is also lined with hook and loop elements. When the golf bag cover is placed over the clubs, the hook and loop elements on the internal surface of the golf bag cover are configured to connect to the hook and loop elements on the external surface of the snake-like retainer 44.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A golf bag cover comprising:

a flexible container lining;

a plurality of members extending from an interior top surface of the golf bag cover to a bottom of the golf bag cover;

wherein the plurality of extending members define at least one opening between the plurality of extending members;

wherein the at least one opening is configured to receive at least one golf club;

a plurality of microbeads contained within at least one layer of the flexible container lining;

at least one valve connected to the flexible container lining; and wherein the flexible container lining and the plurality of microbeads are configured to conform to the at least one golf club upon evacuation of air from the flexible container lining.

2. The golf bag cover of claim 1, wherein the flexible container lining and the at least one valve are configured to connect to at least one vacuum pump operable to evacuate air from the flexible container lining.

3. The golf bag cover of claim 1, wherein the at least one opening is smaller than a club head of the at least one golf club and is configured to deform to enable the club head to enter the golf bag cover.

4. The golf bag cover of claim 1, wherein the plurality of microbeads are configured to granularly jam upon evacuation of air from the flexible container lining.

5. The golf bag cover of claim 1, wherein the at least one opening includes an elongated stalk region configured to house a shaft of the at least one golf club and a head compartment configured to house a club head of the at least one golf club.

6. The golf bag cover of claim 1, further comprising a zipper mechanism configured to engage a corresponding zipper mechanism of a top rim of a golf bag.

7. The golf bag cover of claim 1, wherein the flexible container lining is configured to enable a variable amount of air to be evacuated.

8. The golf bag cover of claim 1, wherein the plurality of extending members define one to seven openings.

9. The golf bag cover of claim 1, further comprising a retainer configured to contact a section of a shaft of the at least one golf club.

10. The golf bag cover of claim 9, wherein the retainer includes two to four linear extensions configured to attach to an interior surface of the golf bag cover.

11. The golf bag cover of claim 9, wherein the retainer includes at least one valve configured to connected to a vacuum pump.

12. A system for housing golf clubs comprising:

a golf bag cover;

a flexible container lining;

a plurality of members extending from an interior top surface of the golf bag cover to a bottom of the golf bag cover;

wherein the plurality of extending members define at least one opening between the plurality of extending members;

wherein the at least one opening is operable to receive at least one golf club;

a plurality of microbeads contained within at least one layer of the flexible container lining;

at least one valve connected to the flexible container lining; and wherein the flexible container lining and the plurality of microbeads are operable to conform to the at least one golf club upon evacuation of air from the flexible container lining.

13. The system of claim 12, wherein the flexible container lining and the at least one valve are operable to connect to at least one vacuum pump operable to evacuate air from the flexible container lining.

14. The system of claim 12, wherein the at least one opening is smaller than a club head of the at least one golf club and is operable to deform to enable the club head to enter the golf bag cover.

15. The system of claim 12, wherein the plurality of microbeads are operable to granularly jam upon evacuation of air from the flexible container lining.

16. The system of claim 12, wherein the at least one opening includes an elongated stalk region configured to house a shaft of the at least one golf club and a head compartment configured to house a club head of the at least one golf club.

17. A golf bag cover comprising:

a flexible container lining;

a plurality of members extending from an interior top surface of the golf bag cover to a bottom of the golf bag cover;

wherein the plurality of extending members define at least one opening between the plurality of extending members;

wherein the at least one opening is configured to receive at least one golf club;

a plurality of microbeads contained within at least one layer of the flexible container lining;

at least one valve connected to the flexible container lining;

wherein the flexible container lining and the plurality of microbeads are configured to conform to the at least one golf club upon evacuation of air from the flexible container lining;

wherein the flexible container lining and the at least one valve are configured to connect to at least one vacuum pump operable to evacuate air from the flexible container lining; and wherein the at least one opening is smaller than a club head of the at least one golf club and is configured to deform to enable the club head to enter the golf bag cover.

18. The golf bag cover of claim 17, wherein the plurality of microbeads are configured to granularly jam upon evacuation of air from the flexible container lining.

19. The golf bag cover of claim 17, wherein the at least one opening includes an elongated stalk region configured to house a shaft of the at least one golf club and a head compartment configured to house a head of the at least one golf club.

20. The golf bag cover of claim 17, further comprising a zipper mechanism configured to engage a corresponding zipper mechanism of a top rim of a golf bag.

* * * * *